US008051784B2

(12) United States Patent
Hsu

(10) Patent No.: US 8,051,784 B2
(45) Date of Patent: Nov. 8, 2011

(54) FOLDING DEVICE FOR A TABLETOP

(76) Inventor: Chuan-Fu Hsu, Taichung (TW)

( * ) Notice: Subject to any disclaimer, the term of this patent is extended or adjusted under 35 U.S.C. 154(b) by 847 days.

(21) Appl. No.: 12/120,234

(22) Filed: May 14, 2008

(65) Prior Publication Data

US 2009/0283020 A1 Nov. 19, 2009

(51) Int. Cl.
*A47B 3/00* (2006.01)

(52) U.S. Cl. ..... 108/115; 108/133

(58) Field of Classification Search ..... 108/115–135, 108/1–10, 168, 172; 312/333, 334.44–334.47
See application file for complete search history.

(56) References Cited

U.S. PATENT DOCUMENTS 2,817,571 A * 12/1957 Lee ..... 312/313
3,217,673 A * 11/1965 Knoblock ..... 108/159.11
3,993,004 A * 11/1976 Alme ..... 108/124
4,068,601 A * 1/1978 Marsh et al. ..... 108/134
4,350,098 A * 9/1982 Shirono et al. ..... 108/6
4,986,195 A * 1/1991 Diffrient ..... 108/150
5,354,027 A * 10/1994 Cox ..... 248/292.14
5,845,589 A * 12/1998 Pfister ..... 108/132
6,343,834 B1 * 2/2002 Wurmlinger ..... 297/14
7,614,351 B2 * 11/2009 Piretti ..... 108/115
2004/0083932 A1 * 5/2004 Kottman et al. ..... 108/115
2005/0235886 A1 * 10/2005 Koning et al. ..... 108/132
2008/0178778 A1 * 7/2008 Koning et al. ..... 108/132

* cited by examiner

*Primary Examiner* — Darnell Jayne
*Assistant Examiner* — Timothy M Ayres

(57) ABSTRACT

A folding device for a tabletop includes a pivot, a first bracket, and a latch mechanism. The pivot is fixed with a pedestal and a base is mounted on the pivot. An opening is defined in the base and extends therethrough longitudinally. The first bracket connects to the pivot rotatably for adapting to the tabletop. The latch mechanism includes a fixed mount, a sliding block, and a paw. The fixed mount is secured to the first bracket and includes a passage corresponding to the opening in the base. The sliding block moves in the passage and includes a groove. The paw connects to the fixed mount pivotally and elastically and includes a first end selectively engaging with the sliding block. The tabletop is un-rotatable when the sliding block extends into the opening in the base.

7 Claims, 5 Drawing Sheets

FOLDING DEVICE FOR A TABLETOP

BACKGROUND OF THE INVENTION

1. Field of the Invention

The present invention relates to a folding device, and more particularly to a folding device for a tabletop.

2. Description of Related Art

A conventional folding table in accordance with the prior art comprises a tabletop, a pair of support pedestals pivotally attached to the tabletop, a pair of pivotal support braces, and a retaining assembly. The conventional folding table is unstable structurally, and therefore the conventional folding table will be folded or collapsed accidentally when the force acting on the tabletop is unbalanced or the folding device is triggered unwittingly. Some other conventional folding table further includes a fastener to secure the folding device. Although the stability of structure is enhanced, the operation of folding or unfolding is more complicated and un-ergonomic.

The present invention has arisen to mitigate and/or obviate the disadvantages of the conventional folding device.

SUMMARY OF THE INVENTION

The main objective of the present invention is to provide an improved folding device for a tabletop so as to avoid folding the tabletop unwittingly.

To achieve the objective, the folding device in accordance with the present invention comprises a pivot fixed with a pedestal, a base mounted on the pivot, an opening defined in the base and extending therethrough longitudinally; a first bracket connected to the pivot rotatably for adapting to a tabletop; and a latch mechanism having a fixed mount, a sliding block, and a paw, the fixed mount secured to the first bracket and having a passage corresponding to the opening, the sliding block moving in the passage and having a groove, the paw connected to the fixed mount pivotally and elastically and having a first end contacting with the sliding block constantly, wherein the tabletop is un-rotatable when the sliding block extends into the opening in the base, the tabletop is rotatable and the first end of the paw engages with the groove in the sliding block when the sliding block retracts into the passage.

Further benefits and advantages of the present invention will become apparent after a careful reading of the detailed description with appropriate reference to the accompanying drawings.

DETAILED DESCRIPTION OF THE INVENTION

Figure 1:
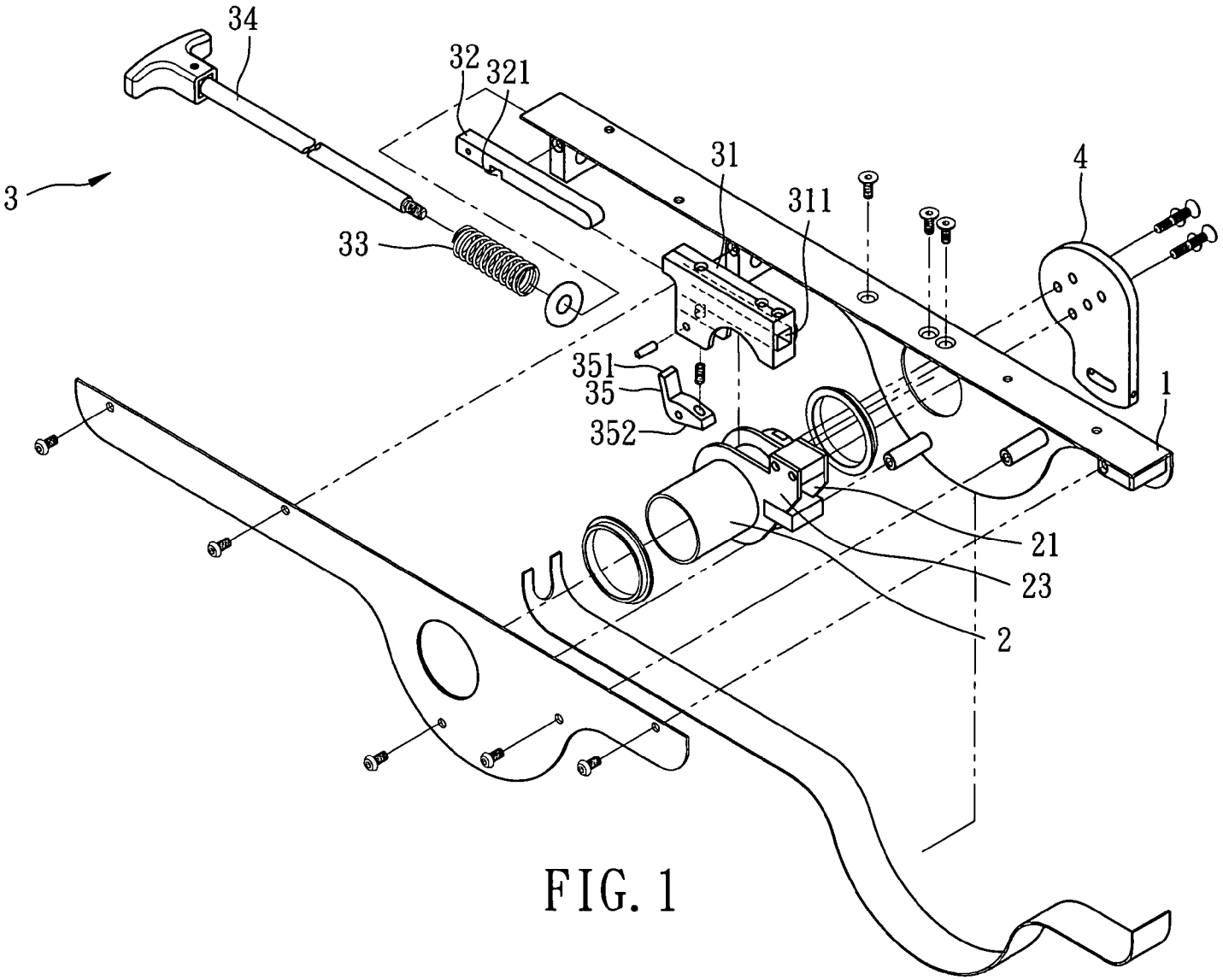
FIG. 1 is an exploded perspective view of a folding device for a tabletop in accordance with the present invention.
Figure 2:
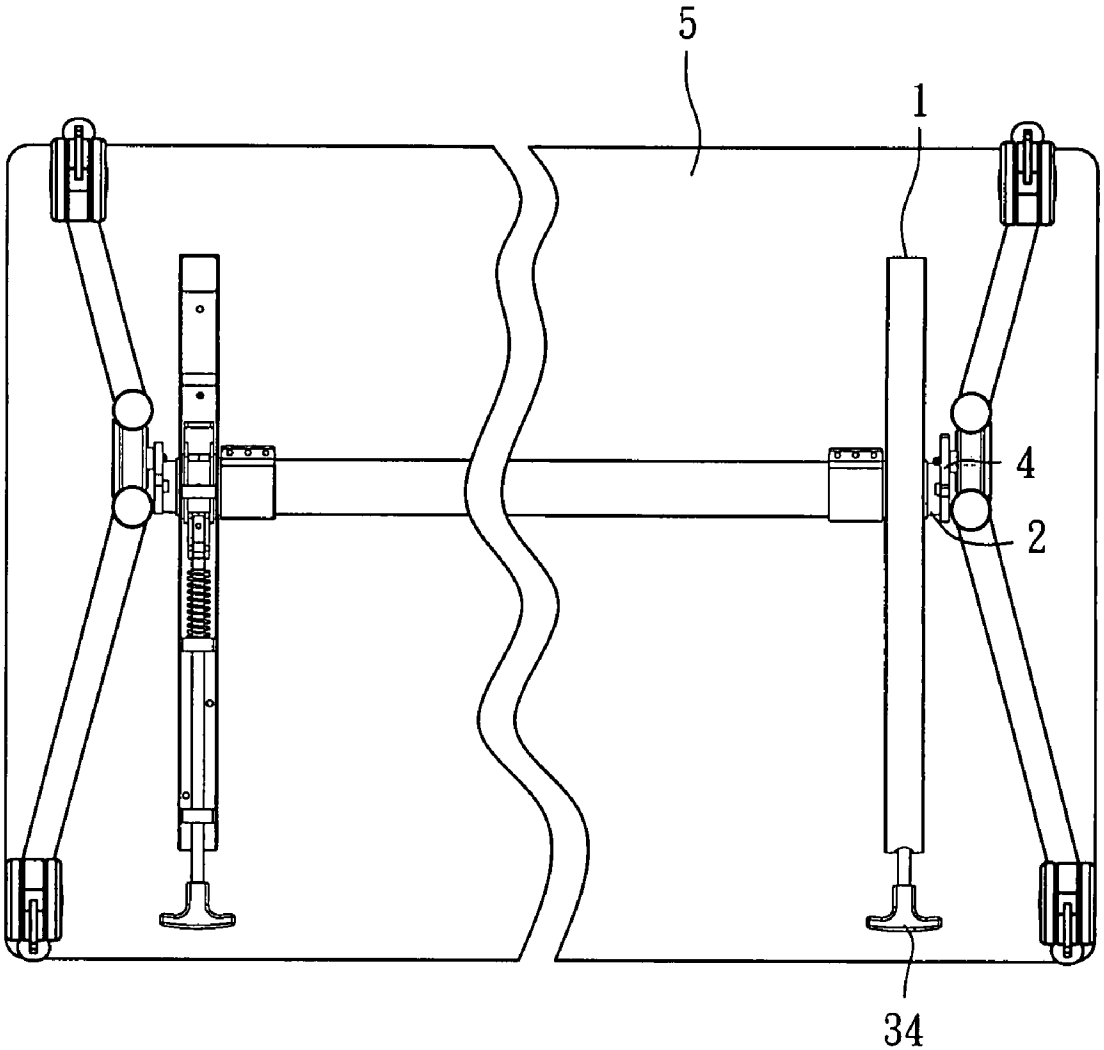
FIG. 2 is a bottom plan view of the folding device for the tabletop in accordance with the present invention.
Figure 3:
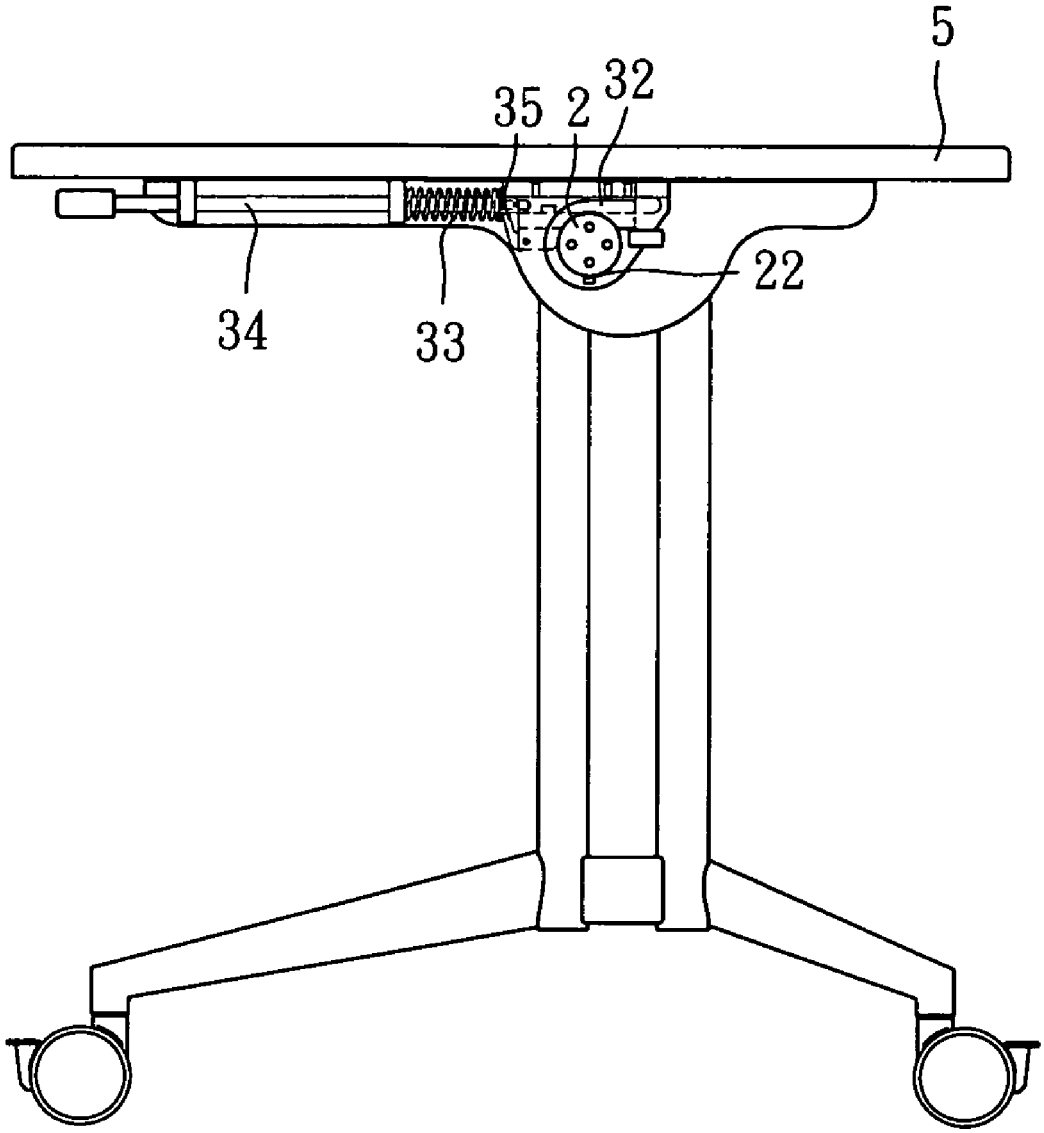
FIG. 3 is a side plan view of the folding device for the tabletop in accordance with the present invention.

Referring to the drawings and initially to FIGS. 1-4, a folding device for a tabletop in accordance with the present invention comprises a first bracket 1 adapted to be mounted to a bottom of the tabletop 5, a pivot 2 rotatably and laterally connected to the first bracket 1, and a latch mechanism 3 mounted on the first bracket 1 and connected to the pivot 2.

The pivot 2 is connected to a second bracket 4 that is fixed with a pedestal for standing the tabletop 5. A base 23 is mounted on the pivot 2 transversally and surrounding the pivot 2. An opening 21 is defined in the base 23 and extends therethrough longitudinally. The base 23 has a rib 22 radially mounted thereon and having a predefined angle relative to the horizontal.

The first bracket 1 is adapt to be mounted to a bottom of the tabletop 5 such that the tabletop 5 is rotatable for folding purpose relative to a connection between the first bracket 1 and the pivot 2.

The latch mechanism 3 includes a fixed mount 3 1, a sliding block 32, a resilient member 33, a rod 34, and a paw 35. The fixed mount 31 is secured to the first bracket 1 and has a passage 3 11 longitudinally therein for linearly corresponding to the opening 21 in the base 23. The sliding block 32 moves in the passage 311 and has a groove 321 defined in a bottom thereof. The rod 34 is longitudinally connected to the sliding block 32 for reciprocally driving the sliding block 32 and the resilient member 33 is sleeved on the rod 34 for providing a restitution force to the sliding block 21 after the rod 34 pulling the sliding block 32. The paw 35 is connected to the fixed mount 31 pivotally and elastically. The paw 35 has a first end 351 selectively engaged with the groove 321 in the sliding block 32 and a second end 352 opposite to the first end 351.

Figure 4:
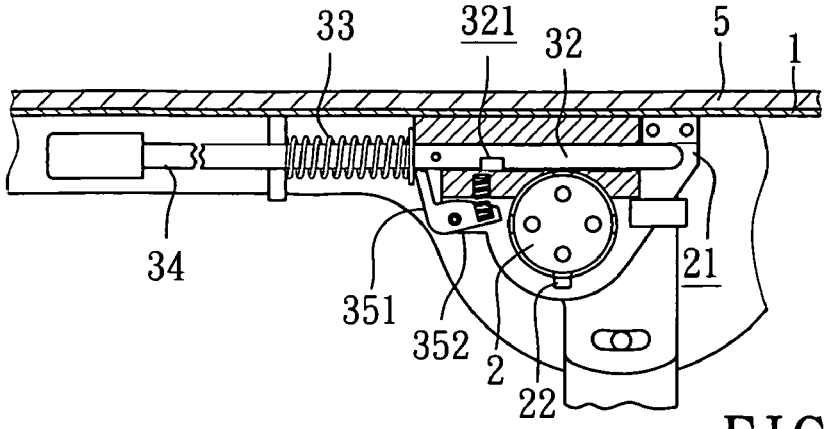
FIG. 4 is an enlarged side plan view of the folding device in accordance with the present invention in partial cross section.

The fixed mount 31 latches with the base 23 when the sliding block 32 extends into the opening 21 in the base 23, and therefore the tabletop 5 is un-rotatable, as shown in FIG. 4. The fixed mount 31 unlatches with the base 23 when the sliding block 32 retracts into the passage 311, and therefore the tabletop 5 is rotatable. The first end 351 of the paw 35 engages with the groove 321 in the sliding block 32 and a position of the sliding block 32 is retained when the sliding block 32 retracts in a predefined distance. When rotating the tabletop 5 and reaching the predefined angle, the rib 22 presses the second end 352 of the paw 35 and the first end 351 of the paw 35 is disengaged with the groove 321 in the sliding block 32. Therefore the sliding block 32 is pushed by the resilient member 33 and extends out of the passage 311.

Figure 5:
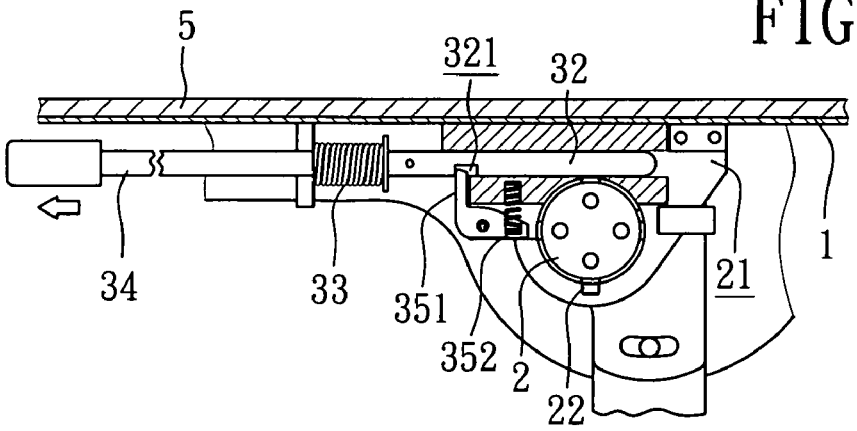
FIG. 5 is a first operational side view of the folding device in accordance with the present invention as pulling a rod in partial cross section.
Figure 6:
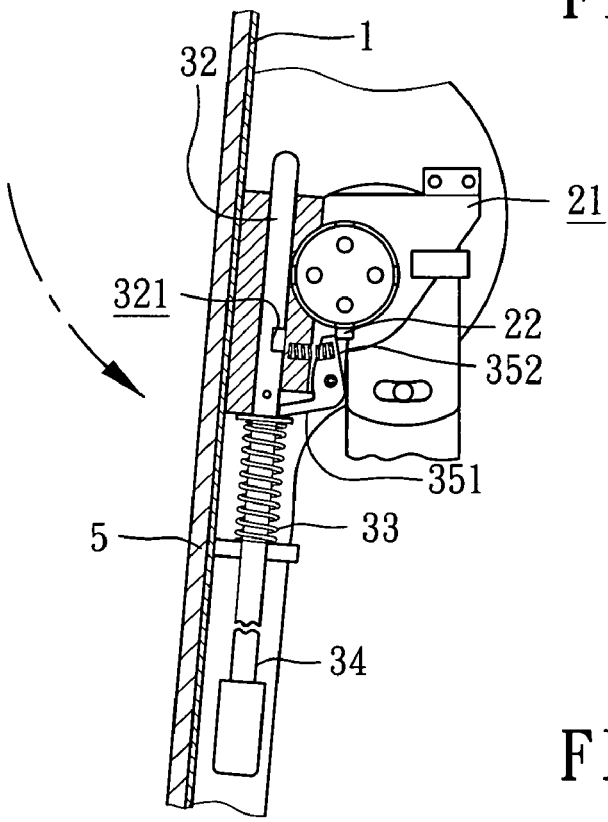
FIG. 6 is a second operational side plan view of the folding device in accordance with the present invention as rotating the tabletop in partial cross section.
Figure 7:
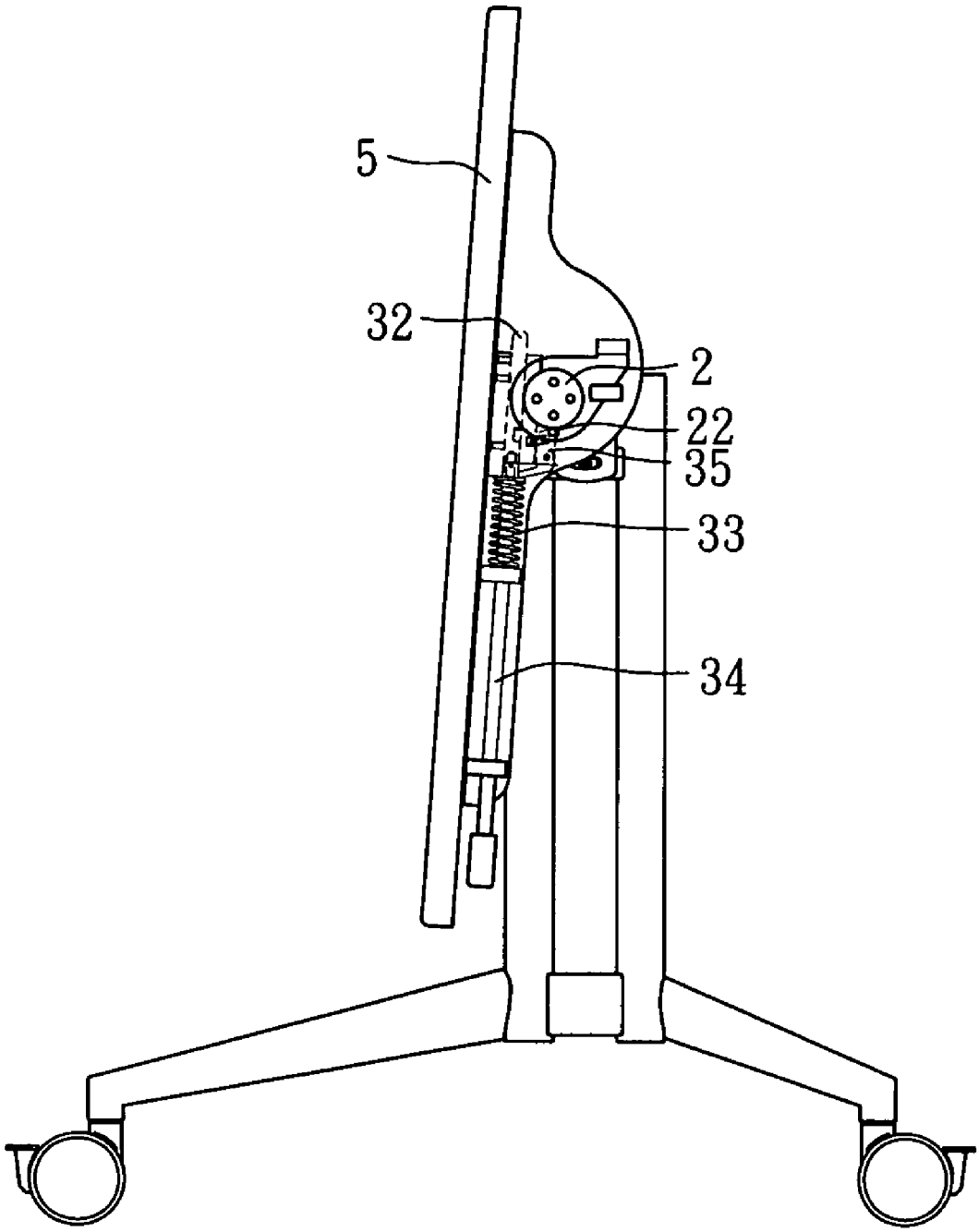
FIG. 7 is a side plan view of the folding device in accordance with the present invention as the tabletop is folded.

Referring to FIGS. 5 and 6, the operational view of the folding device in accordance with the present invention is illustrated. The first end 351 of the paw 35 is engaged with the groove 321 in the sliding block 32 and the sliding block 32 is disengaged with the base 23 when pulling the rod 34 in the predefined distance as shown in FIG. 5. The tabletop 5 is free to rotate. After reaching the predefined angle, the rib 22 presses the second end 352 of the paw 35 and the first end 351 of the paw 35 is disengaged with the groove 321 in the sliding block 32 as shown in FIG. 6. The tabletop 5 is folded, as shown in FIG. 7.

When unfolding the tabletop 5, the user does not need to pull the rod 34. The sliding block 32 will retract into the passage 311 slightly as the sliding block 32 contacts with the base 23. In the following, the sliding block 32 is pushed by the resilient member 33 and extends into the opening 21 in the base 23. The sliding block 32 is engaged with the base 23 to avoid the tabletop 5 from being folded accidentally.

Although the invention has been explained in relation to its preferred embodiment, it is to be understood that many other possible modifications and variations can be made without departing from the spirit and scope of the invention as hereinafter claimed.

What is claimed is:

1. A folding device, comprising:

a first bracket adapted to be mounted to a bottom of a tabletop;

a pivot laterally and pivotally mounted to the first bracket and adapted to be fixed with a pedestal for standing the tabletop, a base mounted on the pivot, an opening defined in the base and extending therethrough longitudinally;

a latch mechanism mounted on the first bracket and connected to the pivot, the latch mechanism having a fixed mount, a sliding block and a paw, the fixed mount secured to the first bracket and having a passage defined therein for linearly corresponding to the opening, the sliding block moving in the passage and having a groove defined therein, the paw connected to the fixed mount pivotally and elastically and having a first end selectively engaged with the sliding block; and the latch mechanism including a resilient member connected to the sliding block for pushing the sliding block along the passage, a second end of the paw being pushed by a rib disposed on the base and the first end of the paw being disengaged with the groove in the sliding block when rotating the tabletop by a defined angle;

wherein the tabletop is un-rotatable when the sliding block extends into the opening in the base, the tabletop is rotatable and the first end of the paw engages with the groove in the sliding block when the sliding block retracts into the passage.

2. The folding device as claimed in claim 1, wherein the latch mechanism includes a rod longitudinally connected to the sliding block for driving the sliding block.

3. The folding device as claimed in claim 2 further comprising a second bracket laterally mounted to the pivot.

4. The folding device as claimed in claim 1, wherein the latch mechanism includes a rod longitudinally connected to the sliding block for driving the sliding block.

5. The folding device as claimed in claim 4 further comprising a second bracket laterally mounted to the pivot.

6. The folding device as claimed in claim 1 further comprising a second bracket laterally mounted to the pivot.

7. The folding device as claimed in claim 1 further comprising a second bracket laterally mounted to the pivot.

* * * * *